United States Patent [19]

Neuroth

[11] Patent Number: 4,927,386

[45] Date of Patent: May 22, 1990

[54] ELECTRICAL CABLE CONNECTOR FOR USE IN OIL WELLS

[75] Inventor: David H. Neuroth, Hamden, Conn.

[73] Assignee: Hubbell Incorporated, Orange, Conn.

[21] Appl. No.: 234,574

[22] Filed: Aug. 22, 1988

[51] Int. Cl.[5] ..... H01R 13/40

[52] U.S. Cl. ..... 439/589; 439/201; 439/278; 439/588

[58] Field of Search ..... 439/201, 263, 278, 279, 439/587–589, 730, 936

[56] References Cited

U.S. PATENT DOCUMENTS

| | | | |
|---|---|---|---|
| 3,381,260 | 4/1968 | Brown | 439/589 |
| 3,845,450 | 10/1974 | Cole et al. | 439/201 |
| 3,945,700 | 3/1976 | Didier | 439/589 |
| 3,972,581 | 8/1976 | Oldham | 439/201 |
| 4,583,804 | 4/1986 | Thompson | 439/588 |
| 4,585,287 | 4/1986 | Ramsey et al. | 439/588 |
| 4,666,242 | 5/1987 | Cairno | 439/588 |
| 4,723,230 | 2/1988 | Chelminski | 439/201 |

*Primary Examiner*—P. Austin Bradley

*Attorney, Agent, or Firm*—Jerry M. Presson; Alfred N. Goodman

[57] ABSTRACT

An electrical cable connector for connecting an electrical cable to an electric motor, especially in an oil well. The electrical cable connector includes a hollow cylindrical housing receiving a portion of the electrical cable therein and a sealing assembly for sealing the space between the cable and the housing to prevent the corrosive material in the oil well from eroding the electrical connection. The sealing assembly includes a disk rigidly coupled to the housing and a movable disk axially biased towards the other disk. A sealing plug is positioned between the two disks and comprises a substantially uncured flowable, incompressible seal material sandwiched between a pair of cured rubber sealing disks. The movable disk asserts pressure on the sealing plug so that the flowable material will flow into any otherwise empty spaces between the sealing disks and the cable and between the sealing disks and the housing.

14 Claims, 2 Drawing Sheets

ELECTRICAL CABLE CONNECTOR FOR USE IN OIL WELLS

FIELD OF THE INVENTION

This invention relates to a cable connector for connecting electrical cables to electric motors, especially in oil wells. More specifically, the invention relates to an electrical cable connector having a housing, a plurality of insulated electrical conductors, and a sealing assembly which will maintain the integrity of the seal even after many cycles of temperature expansion and contraction of the seal assembly. The seal assembly includes a seal plug having a flowable rubber seal material that flows into the otherwise empty spaces between the conductors and the housing. The seal plug is maintained under pressure between a disk rigidly coupled to the housing and an axially spaced disk slidably coupled to the housing.

BACKGROUND OF THE INVENTION

Typically, electrical connections (potheads) to electrical submersible pumps (ESPs) used in oil wells are made by installing a cured rubber grommet with a jamb nut threaded into the face of the pothead. This causes the rubber seal member to tighten against the insulated conductor and effect a seal. When the pothead is placed in service, the temperature increases due to the elevated temperature of the oil well and the added temperature rise of the motor. Because the coefficient of thermal expansion of rubber is approximately 10 times more than that of steel, the pressure in the seal area increases dramatically with the increasing temperature. This elevated pressure causes the cable insulation to reduce in diameter and gradually extrude out of the seal area. If the pump is operated over an extended period of time under these conditions, as is usually the case, the deformed insulation will take a permanent set, resulting in a necked-down conductor insulation in the seal area. When the temperature is reduced, as when the pump is turned off for a short while, the seal member contracts and no longer fits tightly against the insulation of the conductor. As a result, the pothead fails to prevent the ingress of contaminants into the motor, and can ultimately lead to a motor or pothead electrical failure.

Many people have recognized this problem, and a variety of solutions have been proposed, such as urging a movable wall of the seal cavity with springs so that as the seal expands and contracts, the amount of pressure rise will be restricted and, at least in theory, the seal will be maintained against the insulation even after this insulation has deformed and taken a permanent set in its reduced diameter configuration in the seal region.

This common approach to maintaining an effective seal fails to account for a very fundamental mechanism that takes place when the insulated conductors becomed necked-down due to their having taken a permanent set. It has been observed that the reduction of insulation diameter in the seal region is uniformly distributed about each individual conductor. Hence, when the temperature of the device is reduced, the rubber seal must be shortened in length to reduce the diameter of the holes in the seal plug to maintain a seal. Most spring-urged concepts employ a movable disk on one side of the seal plug, which imposes a uniform movement of one surface of the rubber plug. The cross-sectional area of the rubber seal in contact with the outer portions of the insulated conductors is far greater than the cross-sectional area of the rubber seal in contact with the center portions of the insulated conductors. Calculations indicate that to maintain contact of the rubber seal with the reduced diameter insulation in the seal region, five times more reduction in length of the center plug region is required than the outer portions of the plug. A spring-urged movable disk cannot cause such a movement of the center portion of the seal plug with respect to the outside portions. Hence, leaks consistently occur in the center region after temperature cycling, even when sliding disks and springs are used.

This invention addresses this problem in the art, along with other needs which will become apparent to those skilled in the art once given this disclosure.

SUMMARY OF THE INVENTION

Accordingly, a primary object of the invention is to provide an electrical cable connector assembly that maintains the integrity of the seal after numerous temperature cycles have occurred.

Another object of the invention is to provide a seal arrangement in which the conductors can be closely spaced to one another to reduce the overall dimension of the electrical connector.

Another object of the invention is to provide a seal that maintains a uniform pressure equilibrium throughout the seal.

The foregoing objects are basically attained by providing an electrical cable connector, the combination comprising: an insulated electrical conductor having a connecting end; a hollow housing receiving a portion of the electrical conductor therein; and a sealing arrangement, located in the housing, for sealing the space between the housing and the conductor, the sealing arrangement comprising a first sealing assembly coupled to the housing in a relatively stationary position, a second sealing assembly slidably coupled to the housing and axially spaced from the first sealing assembly, a biasing member, coupled to the housing, for biasing the second sealing assembly towards the first sealing assembly, and a dielectric, incompressible sealing material located in the housing between the first and second sealing assemblies, the sealing material being flowable to fill any otherwise empty spaces between the housing and the first and second sealing assemblies and between the conductor and the first and second sealing assemblies under the influence of the biasing member.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings which form part of this original disclosure.

DETAILED DESCRIPTION OF THE INVENTION

Figure 2:
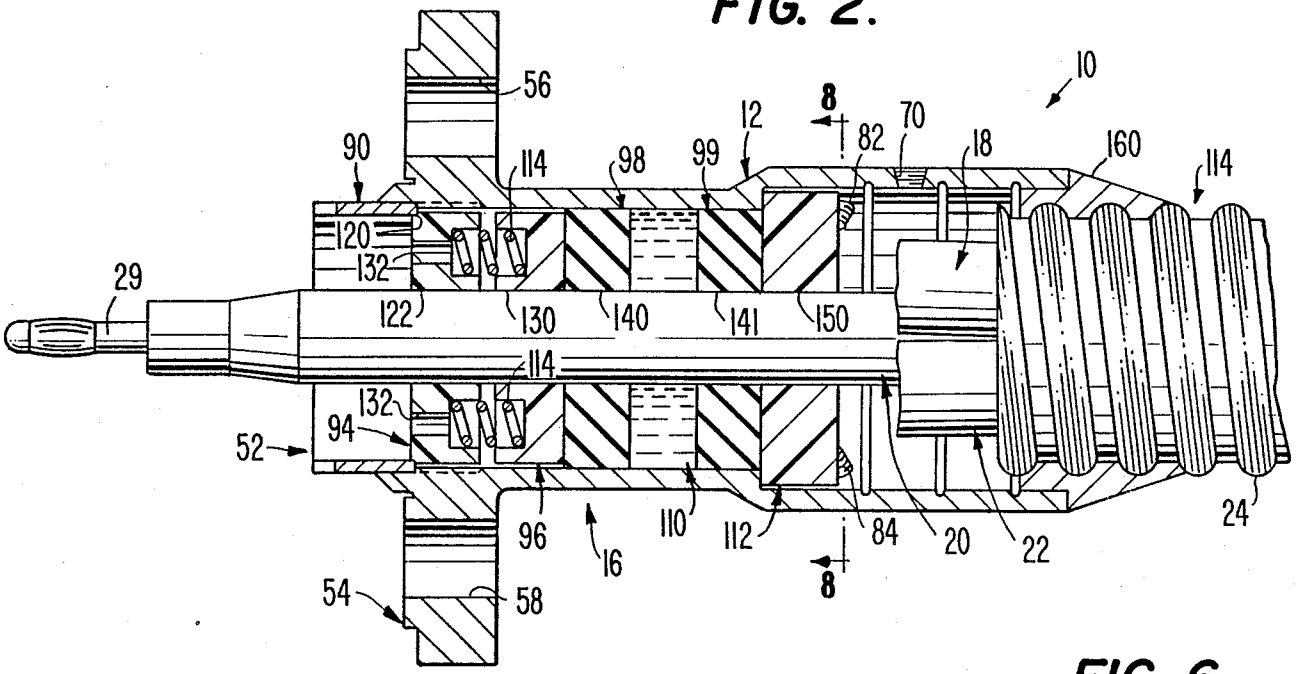
FIG. 2 is a longitudinal cross-sectional view in elevation of the electrical cable connector taken along line 2—2 in FIG. 1 in accordance with the present invention.
Figure 1:
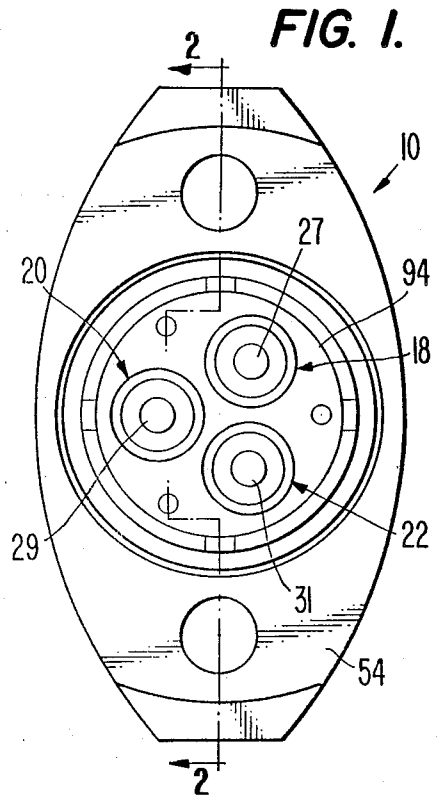
FIG. 1 is an end elevational view of an electrical cable connector in accordance with the present invention.

As seen in FIGS. 1 and 2, the electrical cable connector 10 in accordance with the present invention comprises a generally cylindrical hollow housing 12 receiving a portion of the electrical cable 14 therein and a sealing assembly 16 located in the housing 12 for sealing the space between the housing and the insulated electrical conductors 18, 20 and 22 of the electrical cable 14.

Figure 7:
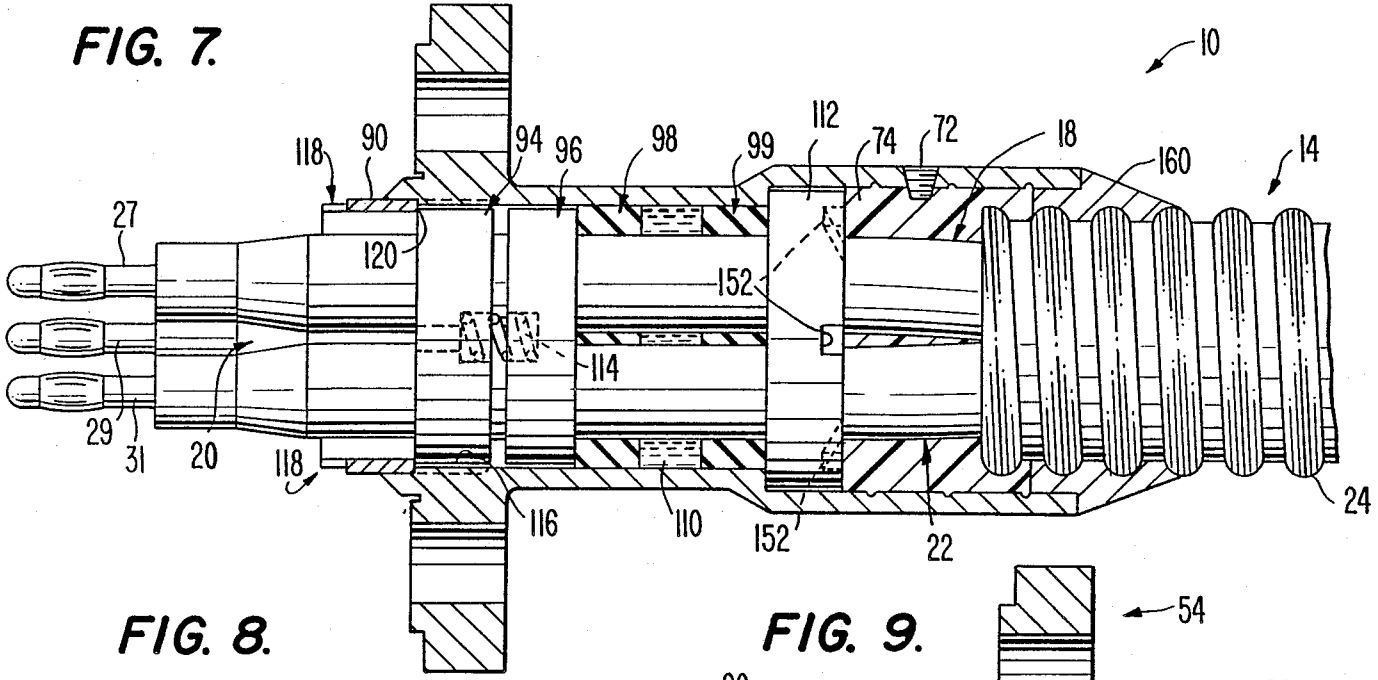
FIG. 7 is a longitudinal cross-sectional elevational view along the center line of FIG. 1 of the cable connector.
Figure 8:
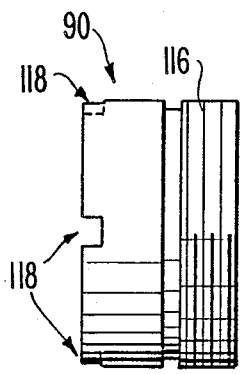
FIG. 8 is a transverse cross-sectional view of the electrical cable connector taken along section line 8—8 in FIG. 2.
Figure 8:
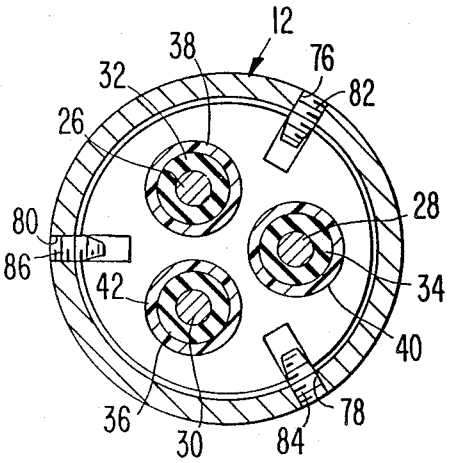

The electrical cable 14 comprises three insulated electrical conductors 18, 20 and 22 surrounded by a rubber filler material (not shown) and a galvanized steel outer shell 24. The three electrical conductors 18, 20 and 22 each have a copper conductor 26, 28 and 30 surrounded by a layer of elastomeric insulation 32, 34 and 36, as seen in FIGS. 7 and 8. The insulation 32, 34 and 36 is preferably formed of ethylene propylene dimonomers and can be coated with a polymeric chemical barrier 38, 40 and 42 on the outer surface thereof, such as that sold under the trademark KYNAR, to protect the conductors 26, 28 and 30 from corrosion. Brass pins 27, 29 and 31, forming connecting ends of each conductor, are threaded and soldered to each copper conductor. The insulation has a shrink-fit tube at its end for sealing the insulation adjacent the connecting ends of the insulated conductors 18, 20 and 22 extending out of the housing through end 52.

Figure 9:
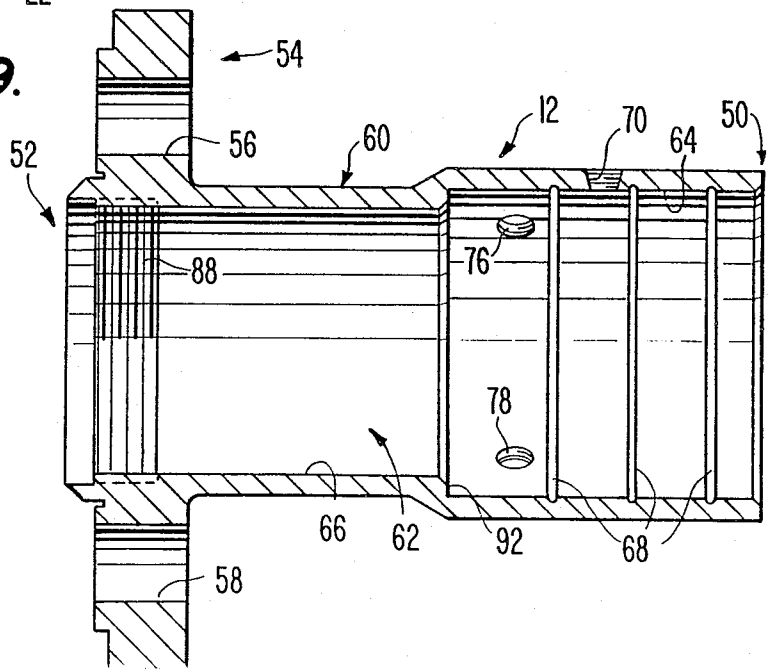
FIG. 9 is an exploded view of the housing in longitudinal cross section and the locking nut in elevation in accordance with the present invention.

As seen in FIG. 9, the housing 12 has a first open end 50 and a second open end 52 with an annular flange 54 extending perpendicular thereto and adjacent the second end 52. The flange 54 has a pair of holes 56 and 58 extending axially therethrough for coupling the electrical connector 10 to an electrical motor or the like, such as via bolts. The housing 12 has a substantially cylindrical outer surface 60 and a substantially cylindrical inner surface 62. The housing 12 further includes a first cylindrical portion 64 and a second cylindrical portion 66. The first cylindrical portion 64 has a greater diameter than the second cylindrical portion 66 and has an axially-facing circumferential shoulder 92 extending radially inwardly from its inner surface to the inner surface of the second cylindrical portion 66.

The first cylindrical portion 64 includes three axially spaced grooves 68 extending circumferentially about the inner surface 62 of the first cylindrical portion 64. The first cylindrical portion 64 also includes a set screw hole 70 extending radially through the housing 12. The set screw hole 70 is threaded for receiving a set screw 72 therein. The set screw hole 70 allows for a two-part epoxy mix 74 to be injected into the interior of the housing 12 through the set screw hole 70, as seen in FIG. 7. The epoxy mix is received in grooves 68 to aid in resisting relative movement between the cable 14 and the housing 12.

As seen in FIGS. 8 and 9, the first cylindrical portion 64 has three set screw holes 76, 78 and 80 extending radially through the housing 12. The set screw holes 76, 78 and 80 are spaced 120° apart around the circumference of the first cylindrical portion 64 and are threaded for receiving set screws 82, 84 and 86 therein, respectively.

The second cylindrical portion 66 includes an internally threaded portion 88 adjacent the second end 52 of the housing 12 adapted to threadedly receive locking ring 90.

The sealing assembly 16, as seen in FIGS. 2 and 7, includes a locking ring 90, a left disk 94, a movable disk 96, a pair of rubber seals 98 and 99, a flowable rubber sealing material 110 which is incompressible and dielectric, a right disk 112, and three compression springs 114.

As seen in FIGS. 7 and 9, the locking ring 90 is a cylindrical sleeve, having an externally threaded portion 116 at one end and four equally spaced notches 118 at its other end for receiving a wrench, not shown. The locking nut 90 has an abutment shoulder 120 on its inner surface for contacting the left disk 94.

Figure 3:
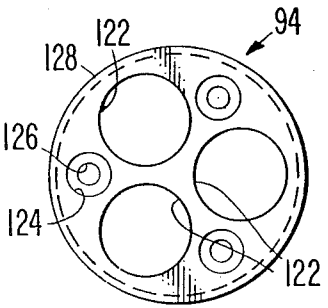
FIG. 3 is a right end view of .the left disk in the sealing assembly.

As seen in FIG. 3, the left disk 94 can be made of a dielectric glass reinforced polymeric material, such as polyetheretherketone (PEEK), or steel. The left disk 94 has an outer cylindrical shape, having three holes 122 extending axially therethrough for receiving the insulated conductors 26, 28 and 30 therethrough. The holes 122 are arranged 120° apart. The left disk 94 also includes three axially extending bores 124 positioned in the spaces between the three holes 122 for receiving and retaining one end of the compression springs 114 therein. Each of the bores 124 has a concentric hole 126 extending axially through the remaining portion of the disk 94 to receive a suitable tool for assembling the connector 10. The left disk 94 is retained in the second cylindrical portion 66 and has a diameter slightly less than the diameter of the inner surface 62 at the second cylindrical portion 66 of housing 12. The left disk 94 also has a reduced diameter at its left end forming a shoulder 128 for engaging the internal abutment shoulder 120 on the locking nut as seen in FIG. 2.

Figure 4:
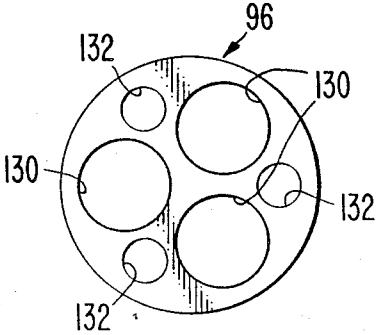
FIG. 4 is a left end view of the movable disk in the sealing assembly.

As seen in FIG. 4, the movable disk 96 has an outer cylindrical shape, having three holes 130 extending axially therethrough and spaced 120° apart for receiving conductors 26, 28 and 30 therethrough. The movable disk 96 also has three axially extending bores 132 positioned in the spaces between the holes 130. The bores 132 extend partially into the movable disk 96 for receiving one end of the compression springs 114. The movable disk 96 is slidably coupled in the second cylindrical portion 66 and has a diameter slightly less than the diameter of the inner surface 62 at the second cylindrical portion 66 of housing 12. The movable disk can be made of a dielectric glass reinforced polymeric material such as polyetheretherketone or steel.

Figure 5:
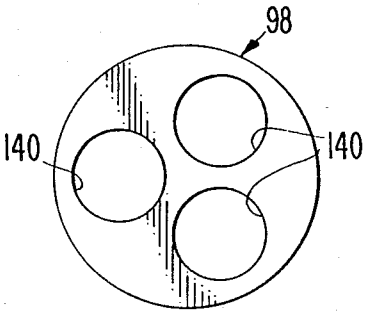
FIG. 5 is a left end view of one of the cured rubber seals in the sealing assembly.

As seen in FIG. 5, the pair of sealing disks 98 and 99 are preferably elastic, are made of fully cured (i.e., vulcanized or cross-linked) rubber and have generally cylindrical outer shapes. The two sealing disks 98 and 99 have three holes 140 and 141, respectively, extending axially therethrough for receiving the insulated electrical conductors 18, 20 and 22 therethrough, the diameters of these holes being slightly less than the outer diameters of the conductors to form a slight interference fit therebetween. The outer diameters of the sealing disks are preferably slightly greater than the diameter of the inner surface 62 at the second cylindrical portion 66 of the housing 12 to form slight interference fits therebetween.

Figure 6:
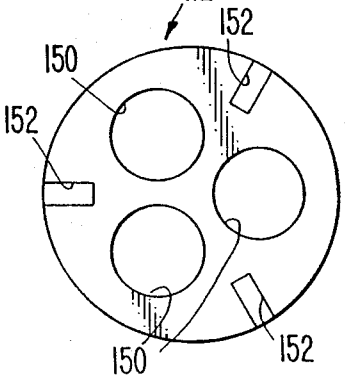
FIG. 6 is a right end view of the right disk in the sealing assembly.

As seen in FIG. 6, the right disk 112 has a generally cylindrical outer shape, having three holes 150 extending axially therethrough and spaced 120° apart for receiving conductors 18, 20 and 22 therein. The diameter of the right disk 112 is slightly less than the diameter of the inner surface 62 at the first cylindrical portion 64 of housing 12. The right disk 112 has three ramps 152 extending radially inwardly from the outer circumferential surface of the disk 112 and sloping axially at about 30° . The ramps 152 are spaced 120° apart and positioned in the spaces between the holes 150. The right disk 112 is positioned in the housing 12 with its left end abutting against the circumferential shoulder 92 and rigidly coupled in a relatively stationary position to the housing 12 by set screws 82, 84 and 86, as seen in FIG. 8 received in the ramps 152. The right disk 112 can be made of a dielectric glass reinforced polymeric material, such as polyetheretherketone plastic, or steel.

Disk 112 and sealing disk 99 form a first sealing assembly, and disk 96 and sealing disk 98 form a second sealing assembly, the first and second sealing assemblies together with sealing material 110 defining a sealing area in the housing.

The flowable seal material 110 is preferably made of a synthetic rubber compound such as ethylene propylene monomers (EPM), ethylene propylene dimonomers (EDPM), olefins, silicone rubbers or fluorinated rubbers, and is advantageously incompressible and dielectric. Advantageously, the flowable seal material 110 can be made of the same material as the insulation on the conductors and seals 98 and 99 but with less curing agent. This provides chemical compatibility and dielectric equality.

If flowable seal material 110 has no curing agent and thus is not curable, its Mooney viscosity is between 10 LM (Large Mandrel) to 30LM at 212° F. when tested according to ASTM methods D-3346 and D-1646-74. The viscosity of the flowable seal material 110 may be changed by adding small amounts of a curing agent, such as a peroxide curing agent. One such peroxide curing agent is sold under the trademark VUL-CUP which is a dialkyl peroxide (2.5-dimethyl-2.5-di(t-butylperoxy)hexane). When small amounts of curing agents (such as 10% of the normal recommended level for EDPM insulation) are used, the Mooney viscosity of the flowable seal material 110 may be raised to between 40 LM and 60 LM upon curing. The preferred Mooney viscosity is about 48 LM for most oil well operations and should preferably be less than 120 LM to flow adequately. However, it would be apparent to those skilled in the art that different viscosities are required for different temperatures.

In any case, the viscosity of the flowable seal material 110 is such that it will flow under the pressure of springs 114 to seal any otherwise empty spaces between the conductors 18, 20 and 22 and the seals 98 and 99 and the housing inner surface 62 and the seals 98 and 99, but will not flow out of the seal assembly 16. Thus, the connector remains sealed even after numerous temperature cycles.

The three compression springs 114 each apply a force of about 24 pounds when adjusted to the position seen in FIGS. 2 and 7. Advantageously, at ambient temperature and pressure, the axial spacing between disks 94 and 96 is about 0.018 inch, and the axial spacing between the left end of disk 94 and the right end of springs 114 is about 0.539 inch. This provides a working pressure of about 110 psi within the flowable seal material 110. While this is the preferred seal pressure, it will become apparent to those skilled in the art that this invention can operate over a wide range of pressures, but preferably not above 200 psi. In tests, after several temperature cycles between about 75° F. and 300° F., the present invention remained sealed under pressures varying from 10 to 50 psi.

In assembling the electrical cable connector 10, the right disk 112 is first placed over the conductors 18, 20 and 22, and then inserted into the housing 12 to abut against the shoulder 92. The right disk 112 is rigidly coupled to the housing 12 by the set screws 82, 84 and 86. The seal plug formed by the flowable material 110 sandwiched between the sealing disks 98 and 99 is now inserted into the second end 52 of the housing 12 to abut against the right disk 112. Next, the movable disk 96 and the left disk 94 are inserted into the housing 12 with the springs 114 positioned therebetween with their ends retained in the bores 132 and 124, respectively. The locking ring 90 is screwed into the end of the housing 12 to place the sealing disks 98 and 99 and the flowable seal material 110 under uniform pressure via the biasing effect of springs 114. Next, the two-part epoxy mix 74 is injected through the set screw hole 70 to further secure the cable 14 and the right disk 112 in place and set screw 72 is threaded in hole 70. Lastly, cable 14 is then coupled to the housing 12 by solder 160.

Thus, if the insulation on the insulated electrical conductors does deform and leave spaces between the insulation and seals 98 and 99, the flowable seal material can flow into these spaces and maintain the desired seal. Because of the flowable nature of the seal material, the insulated electrical conductors can be placed closely together to reduce the bulk of the connector, while allowing the desired seal to be maintained since the seal material can easily flow into the spaces located between the conductors. By using this invention, the cable connector remains sealed between room temperature and about 300° F.

While only one embodiment has been chosen to illustrate the invention, it will be understood by those skilled in the art that various changes and modifications can be made herein without departing from the scope of the invention as defined in the appended claims.

What is claimed is:

1. An electrical cable connector, the combination comprising:

at least one continuous insulated electrical conductor having a connecting end;

a hollow housing receiving a portion of said electrical conductor therein and having first and second open ends with said electrical conductor being rigidly coupled to said housing adjacent said first open end and said connecting end of said electrical conductor extending outwardly from said second open end of said housing;

means, located in said housing, for sealing the space between said housing and said conductor, said means comprising a first sealing assembly coupled to said housing in a relatively stationary position and having a portion of said conductor extending therethrough, a second sealing assembly slidably coupled to said housing and axially spaced from said first sealing assembly and having a portion of said conductor extending therethrough, a dielectric, incompressible, flowable sealing material located in said housing between said first and second sealing assemblies, and biasing means, coupled to said housing, for biasing said second sealing assembly towards said first sealing assembly for pressuring said sealing material to fill any otherwise empty spaces between said housing and said first and second sealing assemblies and between said conductor and said first and second sealing assemblies under the influence of said biasing means.

2. An electrical cable connector according to claim 1, wherein said first assembly includes a member rigidly coupled to said housing and a seal engaging said member and said housing.

3. An electrical cable connector according to claim 1, wherein said second assembly includes a member slidably coupled to said housing and a seal engaging said member and said housing.

4. An electrical cable connector according to claim 1, wherein said biasing means includes at least one compression spring.

5. An electrical cable connector according to claim 1, wherein said at least one electrical conductor includes three electrical conductors, each having a connecting end.

6. An electrical cable connector according to claim 1, wherein said sealing material is comprised of a rubber material having a limited amount of curing agent therein.

7. An electrical cable connector according to claim 1, wherein said sealing material is comprised substantially of an uncurable rubber material.

8. An electrical cable connector according to claim 1, wherein said sealing material is comprised of ethylene propylene monomers.

9. An electrical cable connector according to claim 1, wherein said sealing material has a Mooney viscosity of from about 40 LM to about 60 LM at 212° F.

10. An electrical cable connector according to claim 1, wherein said biasing means exerts a pressure on said sealing material to obtain a working pressure of about 110 pounds per square inch within said sealing material.

11. An electrical cable connector, the combination comprising:

at least one insulated electrical conductor having a connecting end;

a hollow housing receiving a portion of said electrical conductor therein; and means, located in said housing, for sealing the space between said housing and said conductor, said means comprising a first sealing assembly coupled to said housing in a relatively stationary position, a second sealing assembly slidably coupled to said housing and axially spaced from said first sealing assembly, biasing means, coupled to said housing, for biasing said second sealing assembly towards said first sealing assembly, and a dielectric, incompressible sealing material located in said housing between said first and second sealing assemblies, said sealing material being flowable to fill any otherwise empty spaces between said housing and said first and second sealing assemblies and between said conductor and said first and second sealing assemblies under the influence of said biasing means, said at least one electrical conductor including three electrical conductors, each having a connecting end, said biasing means including three compression springs located in the spaces between said three electrical conductors.

12. An electrical cable connector, the combination comprising:

at least one insulated electrical conductor having a connecting end;

a hollow housing receiving a portion of said electrical conductor therein; and means, located in said housing, for sealing the space between said housing and said conductor, said means comprising a first sealing assembly coupled to said housing in a relatively stationary position, a second sealing assembly slidably coupled to said housing and axially spaced from said first sealing assembly, biasing means, coupled to said housing, for biasing said second sealing assembly towards said first sealing assembly, and a dielectric, incompressible sealing material located in said housing between said first and second sealing assemblies, said sealing material being flowable to fill any otherwise empty spaces between said housing and said first and second sealing assemblies and between said conductor and said first and second sealing assemblies under the influence of said biasing means, said insulated electrical conductor having a layer of insulation surrounding an electrical conductor, said insulation containing a curing agent, the material forming said sealing material being the same as the material forming said insulation layer but with a reduced amount of said curing agent.

13. An electrical cable connector, the combination comprising:

at least one continuous insulated electrical conductor having a connecting end;

a hollow housing receiving a portion of said electrical conductor therein having first and second open ends with said electrical conductor being rigidly coupled to said housing adjacent said first open end and said connecting end of said electrical conductor extending outwardly from said second open end of said housing; and means, located in said housing, for sealing the space between said housing and said conductor, said means comprising means defining a sealing area in said housing and having a portion of said conductor extending therethrough, a dielectric, incompressible, flowable sealing material located in said sealing area, and means for pressurizing said sealing material in said sealing area so that said sealing material fills any otherwise empty spaces in said sealing area.

14. An electrical cable connector according to claim 13, wherein said sealing material is rubber.

* * * * *